United States Patent [19]

Airey, Jr.

[11] Patent Number: 4,911,292

[45] Date of Patent: Mar. 27, 1990

[54] COMBINATION GOLF BAG

[76] Inventor: Edgar D. Airey, Jr., 1222 Corbett Rd., Monkton, Md. 21111

[21] Appl. No.: 135,035

[22] Filed: Feb. 10, 1988

[51] Int. Cl.[4] ..... A63B 55/00

[52] U.S. Cl. ..... 206/315.3; 206/315.4; 206/315.7

[58] Field of Search ..... 206/315.3, 315.4, 315.5, 206/315.6, 315.7, 315.8; 383/37, 111

[56] References Cited

U.S. PATENT DOCUMENTS

| | | | |
|---|---|---|---|
| 1,795,880 | 3/1931 | Mullins | 206/315.4 |
| 1,899,825 | 2/1933 | Reach | 206/315.4 |
| 2,094,186 | 9/1937 | Patrick | 206/315.4 |
| 2,665,727 | 1/1954 | Fite | 150/1.5 |
| 2,708,955 | 5/1955 | Wilkens | 206/315.6 |
| 3,316,951 | 5/1967 | Jacobson | 206/315.4 |
| 3,548,905 | 12/1970 | Renshaw | 206/315.3 |
| 4,266,589 | 5/1981 | Cochran | 206/315.3 |
| 4,657,135 | 4/1987 | Kjose | 206/315.3 |
| 4,673,082 | 6/1987 | Hemme | 206/315.6 |
| 4,709,814 | 12/1987 | Antonious | 206/315.3 |
| 4,767,001 | 8/1988 | Kim | 206/315.4 |

FOREIGN PATENT DOCUMENTS

| | | | |
|---|---|---|---|
| 21884 | 8/1930 | Australia | 206/315.5 |
| 722813 | 3/1932 | France | 206/315.3 |
| 445051 | 4/1936 | United Kingdom | 206/315.5 |

*Primary Examiner*—David T. Fidei
*Attorney, Agent, or Firm*—Leonard Bloom

[57] ABSTRACT

A combination golf bag for carrying golf clubs. A rigid outer bag is provided having an open top. A substantially non-rigid inner bag, having an upper annular portion, is removably disposed in the outer bag. Means is provided for removably securing the upper annular portion of the inner bag to the outer bag when the outer bag is disposed therein. When secured, the inner bag is supported by the outer bag so that it is nested substantially concentrically therein for use therewith. When unsecured, the inner bag may be slidably removed from the outer bag for use apart therefrom. The inner bag may be placed in and removed from the outer bag without the necessity of removing any equipment therefrom.

7 Claims, 13 Drawing Sheets

COMBINATION GOLF BAG

FIELD OF THE INVENTION

The present invention relates to golf bags, and, more particularly to a golf bag having a lightweight "Sunday" bag removably disposed and supported therein for use either therewith or apart therefrom.

BACKGROUND OF THE INVENTION

Conventional golf bags, which are designed for carrying golf clubs, and associated equipment such as shoes, balls, rain gear, towels, etc., are usually fabricated from a material which, while being somewhat flexible, nonetheless possesses substantial rigidity and is relatively heavy and cumbersome. The rigidity is required to provide protection to the items carried therein and to permit the golf bag to remain standing vertically upright when placed on its bottom (or base). Unfortunately, the weight and cumbersomeness of such bags make them difficult to carry over the entire length of a golf course.

In order to alleviate the disadvantages of the fullweight bag, and the need to have a second lighter carrying bag, it has been proposed to utilize instead a lightweight bag fabricated from a lightweight material such as canvas. Such bags are commonly referred to as "Sunday bags". Unfortunately, such material affords little protection to items carried therein, thereby necessitating transferring the contents of the Sunday bag to a fullweight bag during transportation to and from the golf course. Also, such material does not have sufficient rigidity to stand vertically upright when placed on its base. Since this is the position which many bags are stored, it once again necessitates the transference of the contents of the "Sunday bag" to a fullweight bag before the storing thereof. Finally, such "Sunday bags" presented the problem of where they themselves could be stored when not in use. Despite being lightweight, such "Sunday bags" can be relatively bulky requiring a quite large storage space. Since such "Sunday bags" do not have sufficient rigidity, they could not simply be placed in a fullweight bag, for if positioned therein, they tend to collapse and fall to the bottom of the bag, thereby once again necessitating removal of all of the contents from the bag when the next use thereof is desired.

There have been attempts, of which I am aware, to modify both the fullweight bags and the lightweight "Sunday bag", so as to alleviate the above disadvantages. In the U.S. Pat. No. 4,657,135 issued to Kjose a different type of fullweight bag is provided. In Kjose the storage space for the associated equipment is removed from the remainder of the bag, so that the remainder of the bag could be streamlined. The storage space was then built into an equipment carrying case, which can also receive and carry the golf bag therein. While streamlining and lightening, somewhat, the weight of the traditional fullweight bag, the golf bag of Kjose nonetheless are taught to be fabricated from a rigid or semi-rigid material, such as plastic, so as to provide a greater amount of protection to the golf clubs carried within the bag when the bag is transported or shipped. Indeed like traditional bags the lightest material taught by Kjose is a "cloth-like materials along with leather or leather-like material", and Kjose specifically rules out forming this bag from cloth-like material alone. Thus, while due to the streamlining the bag of Kjose is lighter than the traditional fullweight bag, it is nonetheless still substantially heavy and cumbersome to carry.

In U.S. Pat. No. 2,665,727 issued to Fite, a different type of "Sunday bag" is provided that is fabricated from wicker. While this wicker bag does provide both more protection to the clubs during shipment than the ordinary canvas bag and more rigidity in order to stand vertically upright when placed on its base, it is nonetheless easily damaged. Also these bags are significantly more expensive to fabricate than ordinary canvas.

Thus, it can be seen that there remains a need to provide a golf bag which is substantially rigid, so as to provide protection to golf clubs and associated equipment disposed therein during transportation, which can stand vertically upright when placed on its bottom for, i.e. storing, and nonetheless, which has a lightweight Sunday bag fabricated from a relatively non rigid material such as canvas that may be selectively utilized apart therefrom, or in conjunction therewith, without the necessity of either transferring or removing the contents of the Sunday bag therefrom.

SUMMARY OF THE INVENTION

Accordingly, it is a primary object of the present invention to provide a golf bag that is substantially rigid, so as to provide protection to golf clubs and associated equipment disposed therein, for example during transportation or shipping thereof, and which can stand vertically upright when placed on its bottom, for example during storage thereof and which, nonetheless, has a lightweight "Sunday" bag fabricated from a relatively non-rigid lightweight material, such as canvas, which may be selectively utilized apart therefrom, or in conjunction therewith, without the necessity of either removing or transferring the contents of the Sunday bag therefrom.

It is a further object of the present invention to provide such a golf bag wherein the "Sunday" bag is easily, simply and readily removed from and secured to the remainder of the bag for, alternatively, use apart therefrom from or therewith.

It is a further object of the present invention to provide such a bag which is relatively simple and inexpensive to fabricate and utilize.

It is a still further object of the present invention to provide such a golf bag, as outlined above, which utilizes, substantially, the design and appearance of fullweight and lightweight bags presently in use.

In order to achieve the objects of the present invention, it is taught to provide a golf bag having a substantially rigid side wall such as is presently utilized in the art. It is further taught to provide a second golf bag fabricated from a substantially non rigid material. This second bag is nested substantially concentrically in the first bag. In order to prevent "collapsing" of the second bag when it is disposed in the first bag, means is provided to easily removably secure the upper portion of the second bag to the first bag so that the rigidity of the first bag provides support required to prevent the second bag from collapsing.

In accordance with the teachings of the present invention, there is disclosed a golf bag for carrying golf clubs. This bag has an outer bag. The outer bag has a substantially rigid cylindrical side wall, a bottom and an open top. An inner bag is slidably, removably disposed in the outer bag. The inner bag has a substantially non-rigid side wall, a bottom and an open top for removably receiving golf clubs therein. In this fashion, when slidably disposed in the outer bag, the inner bag is nested substantially concentrically therein. The inner bag has an upper annular portion formed on the side wall thereof. Also, means is provided for removably securing the upper annular portion of the inner bag to the outer bag when the inner bag is disposed therein. In this manner, the inner bag may be selectively and alternatively removed from the outer bag for use apart therefrom, or disposed and supported within the outer bag during use thereof.

Preferably, this bag further includes a first ring which is disposed on the side wall of the inner bag. A second ring is disposed on the side wall of the inner bag between the first ring and the bottom of the inner bag. A pair of ring apertures are formed in the side wall of the outer bag. When the inner bag is disposed in the outer bag, each ring is received through a respective ring aperture. When the inner bag is removed from the outer bag, the rings are removed from the respective aperture. A strap is provided having a first end and a second opposite end. A first latch is disposed on the first end of the strap. A second latch is disposed on the second end of the strap. When the inner bag is disposed in the outer bag with the rings received through a respective ring aperture, the first latch may be removably secured to the first ring and the second latch may be removably secured to the second ring. In this fashion, the rings are secured in place and provide a strap for carrying the outer bag having the inner bag disposed therein. When the inner bag is removed from the outer bag for use apart therefrom, the first latch is removably secured to the first ring and the second latch is removably secured to the second ring. This provides a strap for carrying the inner bag when used apart from the outer bag.

In one embodiment, the means for removably securing the upper annular portion of the inner bag to the outer bag when the inner bag is disposed therein includes the upper annular portion of the inner bag having a plurality of apertures formed therein. The cylindrical side wall of the outer bag has a plurality of apertures formed therein. When the inner bag is disposed within the outer bag, a plurality of said apertures formed in the side wall of the outer bag are substantially aligned with a respective aperture formed in the inner bag, thereby defining a plurality of pairs of aligned apertures. The strap may be threadably, removably received through at least a plurality of the said pairs of aligned apertures and secured, so that the upper annular portion of the inner bag is secured to and supported by the outer bag. Also, the strap may be unsecured and threadably removed from the apertures, so that the inner bag may be removed from the outer bag for use apart therefrom.

In a second embodiment, the means for removably securing the upper annular portion of the inner bag to the outer bag when the inner bag is disposed therein, includes a rigid cover which has a first and a second interior passageway formed therein, each of said passageways having a pair of respective open ends. The cylindrical side wall of the outer bag has at least two apertures formed therein for each interior passageway formed in the rigid cover. The upper annular portion of the inner bag has at least two apertures formed therein for each interior passageway formed in the rigid cover. Each of the apertures formed in the cylindrical side wall are aligned with a respective aperture formed in the inner bag when the inner bag is disposed in the outer bag. In this fashion, a respective pair of aligned apertures is defined. Each pair of aligned apertures is further aligned with a respective open end of an interior passageway. A strap having means for removably securing and supporting the upper annular portion of the inner bag to the outer bag is provided. When the inner bag is disposed in the outer bag, the strap may be threadably, removably received through at least one pair of aligned apertures, the open end of the first interior passageway aligned with the one pair of aligned apertures, the first interior passageway, the other open end of the first interior passageway, a pair of aligned apertures aligned with the said other open end, another pair of aligned apertures, the open end of the second interior passageway aligned with the said another pair of aligned apertures, the second interior passageway, the other open end of the second interior passageway and a pair of aligned apertures aligned with the said other open end of the second interior passageway and secured. In this manner, the upper annular portion of the inner bag is secured to and supported by the outer bag. The strap may also be unsecured and threadably removed from the pairs of aligned apertures, the interior passageways and the open ends thereof, so that the inner bag may be removed from the outer bag for use apart therefrom.

In a third embodiment, the means for removably securing the upper annular portion of the inner bag to the outer bag when the inner bag is disposed therein includes a rigid lattice which is disposed over the top of the inner bag. This lattice has a plurality of supporting frame arms. At least one of the supporting arms of the lattice has a first interior passageway formed therein. At least one of the supporting arms of the lattice has a second interior passageway formed therein. Each of said interior passageways has a pair of open ends. A cylindrical side wall of the outer bag. This side wall has at least two apertures formed therein for each interior passageway formed in the lattice. The upper annular portion of the inner bag has at least two apertures formed therein for each interior passageway formed in the lattice. Each of the apertures which are formed in the cylindrical side wall are aligned with a respective aperture formed in the inner bag when the inner bag is disposed in the outer bag, thereby defining a respective pair of aligned apertures. Each pair of aligned apertures further are aligned with a respective open end of an interior passageway. A strap is provided. This strap has means for removably securing and supporting the upper annular portion of the inner bag to the outer bag. When the inner bag is disposed in the outer bag, the strap may be threadably, removably received through, at least, one pair of aligned apertures, the open end of the first interior passageway aligned with the one pair of aligned apertures, the first interior passageway, th other open end of the first interior passageway, a pair of aligned apertures aligned with the said other open end, another pair of aligned apertures, the open end of the second interior passageway aligned with the said another pair of aligned apertures, the second interior passageway, the other open end of the second interior passageway and a pair of aligned apertures aligned with the said other open end of the second interior passageway. Positioned thusly, the strap is secured so that the upper annular portion of the inner bag is secured to and supported by the outer bag. The strap may be unsecured and threadably removed from the pairs of aligned apertures, the interior passageways and the open ends thereof, so that the inner bag may be removed from the aligned apertures, the interior passageways and the open ends thereof. In this manner, the inner bag may be removed from the outer bag for use apart therefrom.

In a fourth embodiment, the means for removably securing the upper annular portion of the inner bag to the outer bag when the inner bag is disposed therein, is comprised of a plurality of hook and hook fasteners. Each fastener has a respective separate hook portion and a loop portion. Each fastener has one of its respective hook or loop portions positioned on the upper annular portion of the inner bag, spaced apart from one another. Each fastener further having the other of one of its respective hook or loop portions disposed on the outer bag, spaced apart from one another. In this manner, when the inner bag is slidably disposed in the outer bag, the hook portions of each fastener mates with its respective loop portion fastening the upper annular portion of the inner bag to the outer bag, whereby the upper annular portion is secured to and supported by the outer bag. Alternatively the respective portions of the fasteners may be unsecured from one another, so that the inner bag may be removed from the outer bag for use apart therefrom. Preferably, three such fasteners are portion provided each of which is disposed being spaced 120° from the other portions.

These and other objects of the present invention will become apparent from a reading of the following specification taken in conjunction with the enclosed drawings.

DESCRIPTION OF PREFERRED EMBODIMENTS

Figure 1:
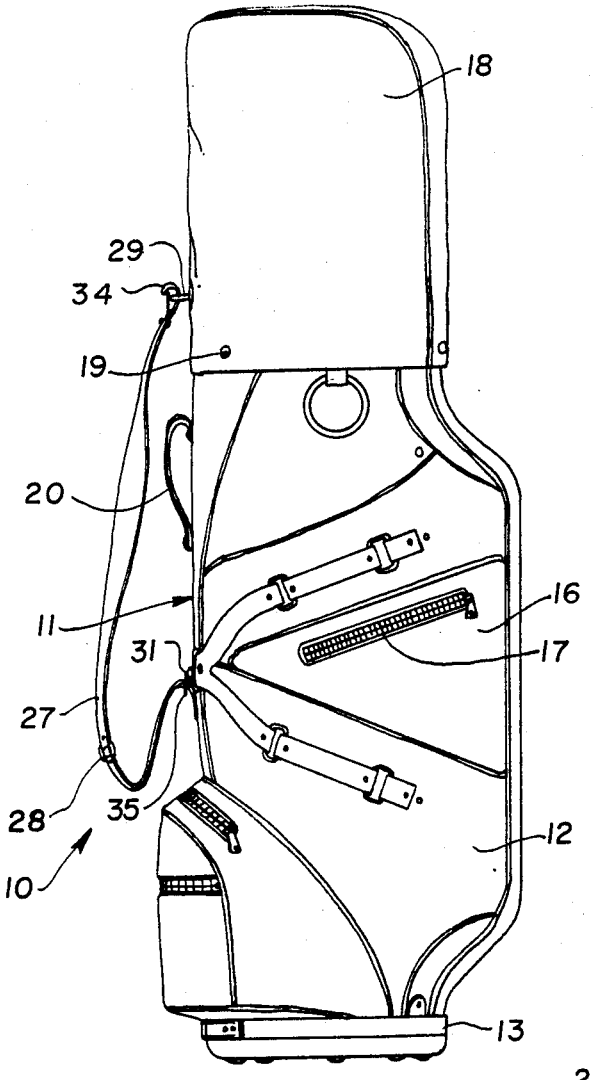
FIG. 1 is a side view of the golf bag of the present invention, wherein the inner bag is disposed in the outer bag for use therewith, and further wherein a cover is positioned being disposed over the heads of the golf clubs which extend out of the bag.
Figure 2:
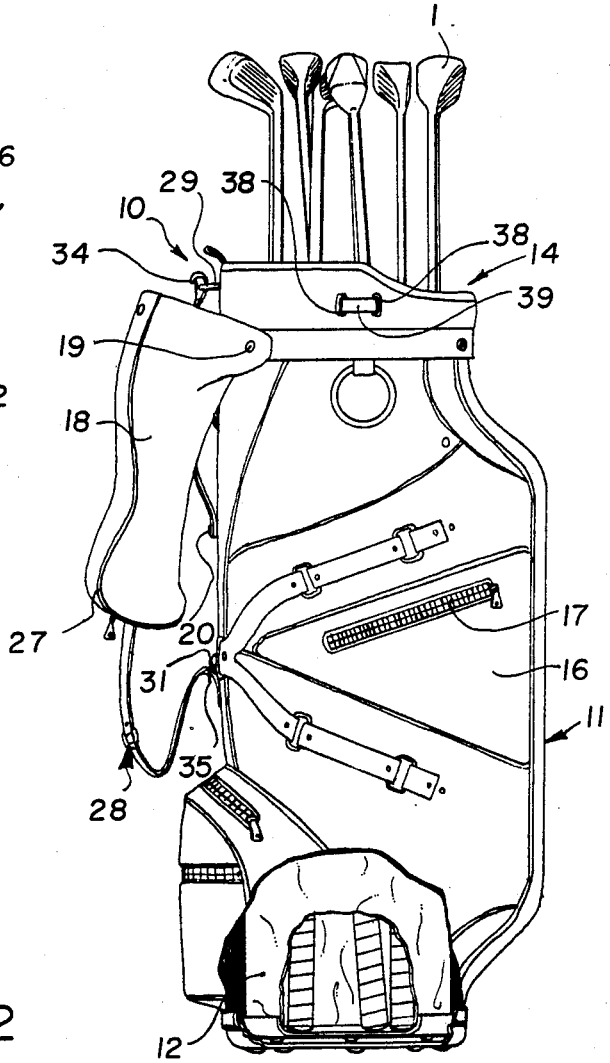
FIG. 2 is another side view relating substantially to FIG. 1, wherein the cover is removed therefrom and parts of the bag are broken away for the sake of clarity.

Referring now to FIGS. 1 and 2, the golf bag 10 of the present invention includes an outer bag 11 and an inner bag 12. The outer bag 11 is very similar in size, shape, structure and appearance to traditional full-weight golf bags presently utilized. The outer bag 11 includes a bottom (base) 13, preferably formed from plastic or some other rigid material. The outer bag 11 further includes an open top 14, through which golf clubs 1 etc. may be disposed, and a substantially cylindrical side wall 15 which extends between the top and the bottom 14 and 13, respectively. An upper annular portion extends about the outer bag 11 contiguous with the open top 14. As with traditional golf bags, it is preferred that the side wall 15 of the outer bag 11 be fabricated from plastic, leather or some other substantially rigid material, so that a substantially rigid cylindrical wall is provided.

If desired, the outer bag may be further formed so as to have one or more storage packets 16 formed therein. As with conventional golf bags, the packets 16 are designed to receive therein associated items, such as golf shoes, balls, tees etc. Preferably, each packet 16 is opened and sealed by a zipper 17. It is also preferred to provide a flexible cover 18 for the bag 10 which, preferably is pivotably secured at a pivot point by, i.e. a rivet 19 to the outer bag 11 for pivotal movement between a first position, wherein it covers and protects the heads of the clubs 1 disposed in the bag (FIG. 1), and a second position wherein the heads of the club are uncovered (FIG. 2).

The outer bag 11 may further have on the side wall thereof, a handle which may be manually gripped to provide a means for supporting the bag by hand.

Figure 3:
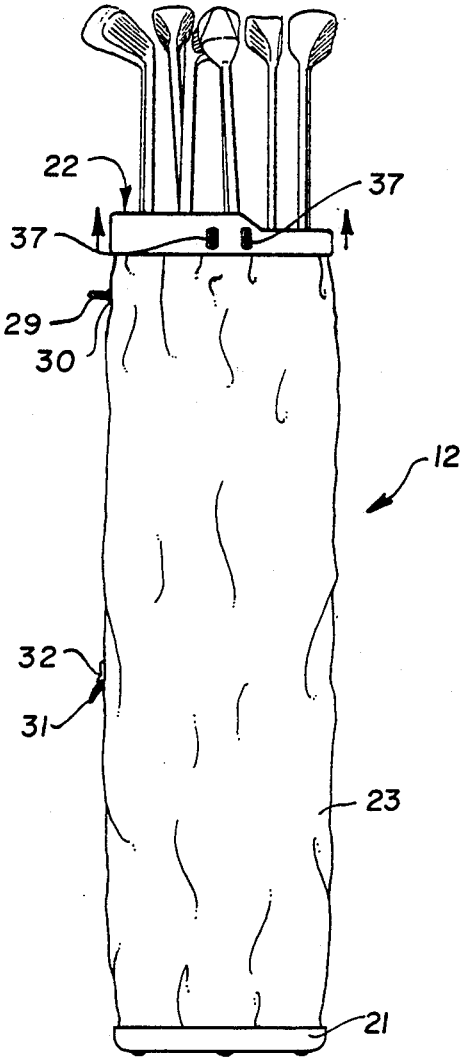
FIG. 3 is a side view of a lightweight inner bag of the present invention.

With additional reference now to FIG. 3, the inner bag 12 is very similar in size, shape and appearance to a traditional lightweight or "Sunday" bag. The inner bag 12 includes a bottom (base) 21 which is preferably formed from plastic, or some other rigid material. The inner bag 12 further has an open top 22 through which golf clubs 1, etc., may be disposed and a substantially cylindrical side wall 23, which extends between the bottom and the top 21 and 22, respectively. It is preferred that the side wall 23 of the inner bag 12 be fabricated from canvas or some other substantially non-rigid, so that a substantially non rigid side wall 23 is provided. The inner bag 12 also has an upper annular portion 24. Preferably, the upper annular portion 24 is adjacent to the open top 22 and, like the upper annular portion of the outer bag 12, forms the periphery or lip of the inner bag 12. In various embodiments, it is preferred to form these upper annular portions, or at least a portion (preferably, an annularly extending portion) of these upper annular portions, from a rigid material such as plastic or leather, although this is not always necessary.

Figure 4:
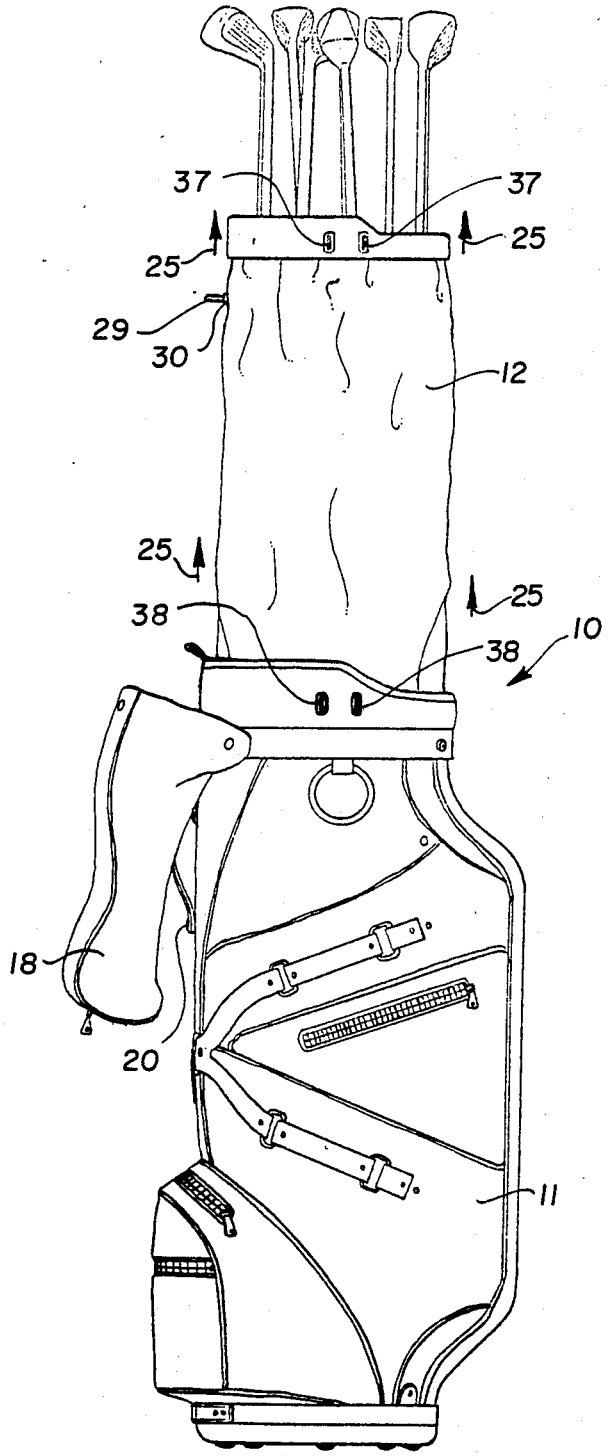
FIG. 4 corresponds substantially to FIG. 1, illustrating the inner bag being slidably removed from the outer bag.
Figure 5:
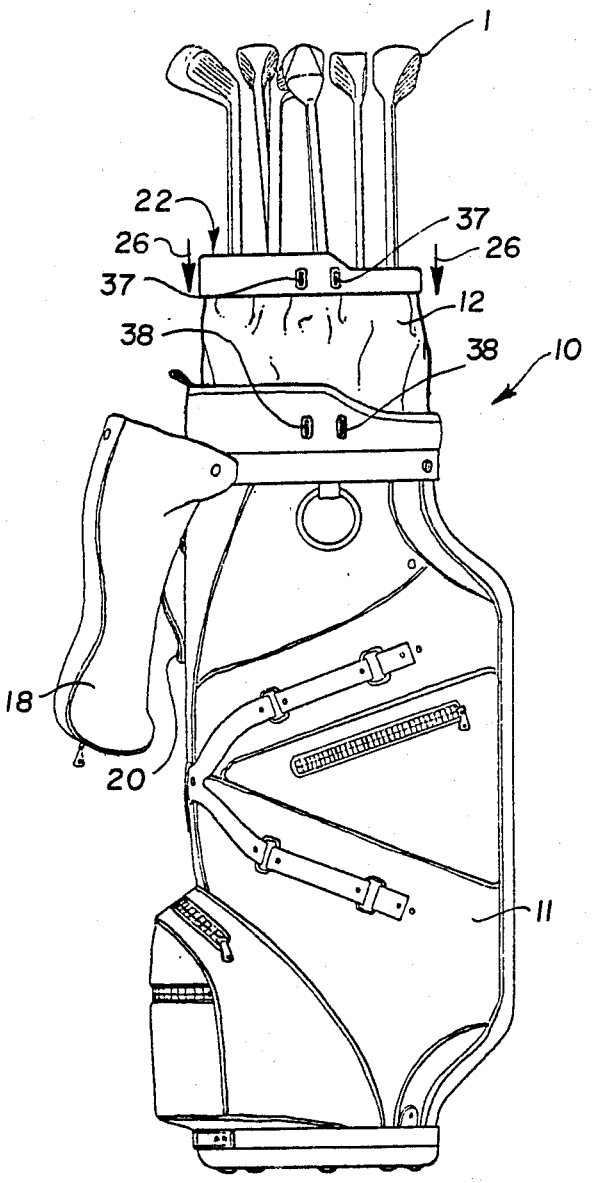
FIG. 5 corresponds substantially to FIG. 1, illustrating the inner bag being slidably placed in the outer bag.
Figure 6:
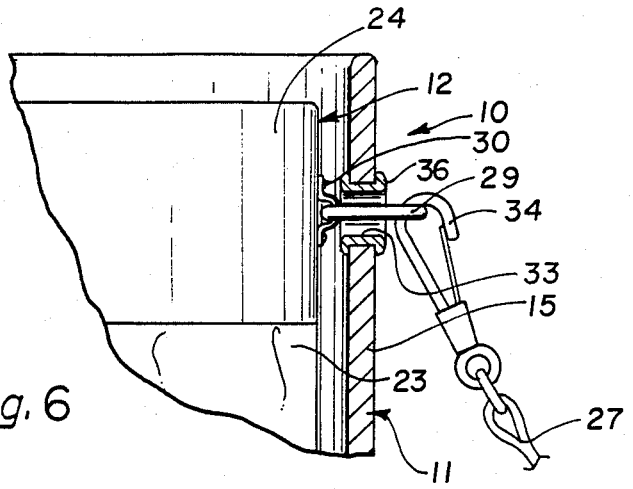
FIG. 6 is a side view, in cross-section, of the bag illustrating how, when the inner bag is disposed in the outer bag, the first ring of the inner bag is received through a respective ring aperture formed in the side wall of the outer bag, and further illustrating the first latch removably secured to the first ring.
Figure 7:
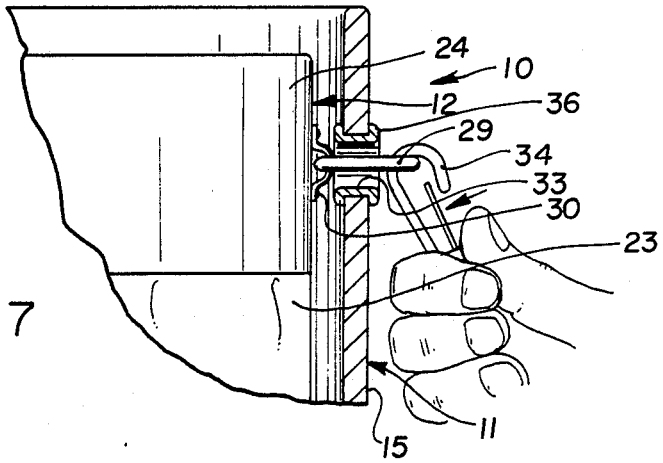
FIGS. 7–10 are side views, in cross-section, corresponding substantially to FIG. 6 illustrating, in stepwise fashion, the unsecuring of the first latch from the first ring and the movement of the first ring through the first ring aperture when the inner bag is removed from the outer bag.

The inner bag 12 may be utilized either with the outer bag 11, such as in the manner of traditional golf bags, or apart therefrom, such as in the manner of a traditional "Sunday bag". When it is desired to utilize the inner bag 12 apart from outer bag 11, the inner bag 12, even with all the equipment still stored therein may, after being unsecured from the outer bag 11 (as will be discussed later in detail), be slidably disposed, in the direction of arrows 25, as shown in FIG. 4, so that the inner bag 12 is removed from the outer bag 11 for use apart therefrom. When it is desired to utilize the inner bag 12 with the outer bag 11, the inner bag may be slidably disposed in the outer bag 11, in the direction of arrows 26, so that the inner bag 12 is nested substantially, concentrically in the outer bag 11 (FIG. 5). Positioned thusly, the bottom 21 of the inner bag 12 nests level upon the bottom 13 of the outer bag 11.

It is to be appreciated that no time during either the inner bags 12 placement in and/or removal from the outer bag 11, is there any necessity to remove any equipment whatsoever from either bag. In this fashion, the use of applicant's "Sunday bag" is greatly simplified over the traditional "Sunday bags" now commonly employed.

Referring now to FIGS. 1–3 and with further reference to FIGS. 6–10, the bag 10 is seen to include a removable shoulder strap 27 for carrying the bag 10, when the inner bag 12 is disposed in the outer bag 11, or for carrying the inner bag 12, when it is utilized alone. Preferably, this shoulder strap 27 is formed having a "belt buckle" arrangement 28, or other suitable means which are well known to those skilled in the art, permitting it to be adjustable.

A first ring 29 is secured to the side wall 23 of the inner bag 12 on or near the upper annular portion 24 by any suitable means such as bracket 30 for pivotal movement relative to the side wall 23. A second ring 31 is disposed on the side wall 23 of the inner bag 12 between the first ring 29 and the bottom (base) 21 of the inner bag 12. Like the first ring 29, this second ring 31 is secured to the side wall 23 by any suitable means such as bracket 32 for pivotal movement relative to the side wall 23.

A first latch 34 is disposed on the first end of the strap 27. A second latch 35 is disposed on its second, opposite end of the strap 27. Latches 34 and 35 are manually, removably attachable to, respectively, the first and second rings 29 and 31, for securing and unsecuring the strap 27 for use.

A pair of ring apertures (a first and a second ring apertures) 33 are formed in the side wall 15 of the outer bag 11. When the inner bag 12 is disposed in the outer bag 11, each ring 29 and 31 is received through a respective ring aperture 33. In that position, the latches 34 and 35 may be attached to the respective ring 29 and 31 so that the rings 29 and 31 are secured in place extending through a respective aperture 33 (see in particular FIG. 6). In this fashion, the strap 27 is secured providing a strap for carrying the outer bag 11 having the inner bag 12 disposed therein.

Figure 8:
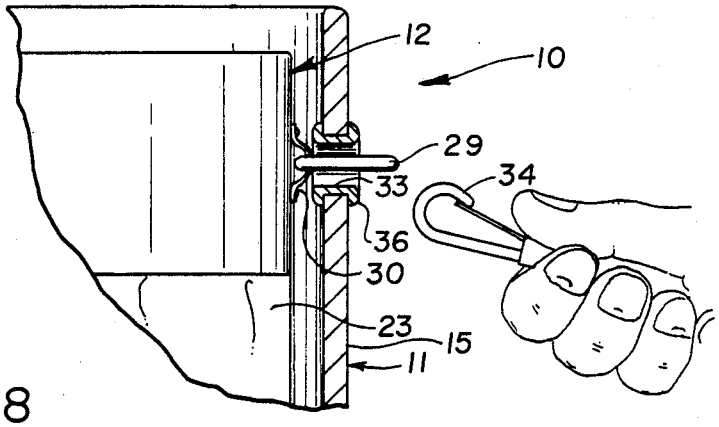
Figure 9:
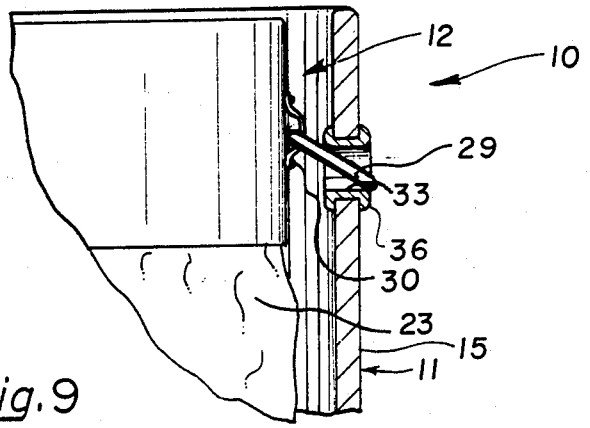
Figure 10:
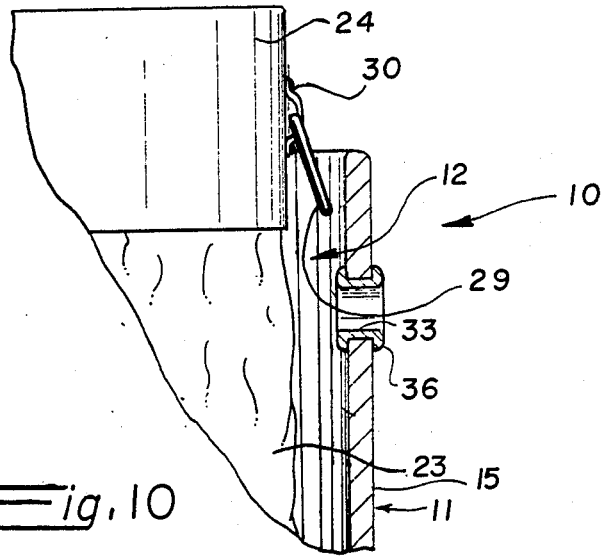
Figure 11:
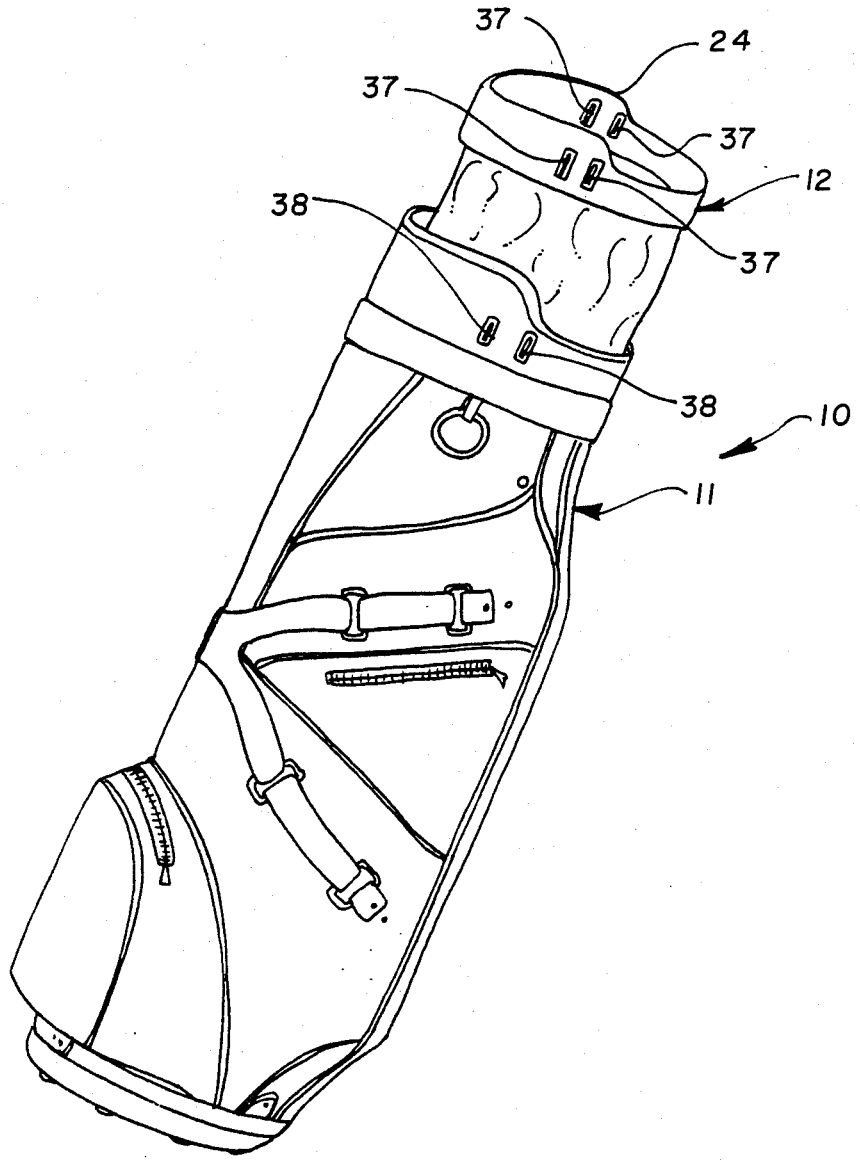
FIG. 11 is a perspective view showing the inner bag being slidably disposed into the outer bag to align the apertures in each.

When the inner bag 12 is to be removed from the outer bag 12, the user first manually unsecures each latch 34 and 35 from its respective ring 29 and 31 (FIG. 7), and removes the strap 27 from the bag 10 (FIG. 8). As the inner bag 12 is removed from the outer bag 11, the rings 29 and 31 pivot and slide through the respective aperture 33 toward the interior of the outer bag 11 (FIG. 9). As sliding removal of the inner bag 12 continues the rings 29 and 31 pivot further, become unseated and are removed from their respective apertures 33. When the removal of the inner bag 12 is completed, so that it may be utilized apart from the remainder of the bag, the first and second latches 34 and 35 may be once again removably attached to a respective ring 29 and 31. In this fashion a strap is provided for carrying the inner bag 12, when said inner bag 12 is used apart from the outer bag 11.

It is preferred that a respective grommet 36 or other suitable means be disposed in apertures 33 to prevent said apertures 33 from ripping, distorting or otherwise being damaged.

Finally means is provided for removably securing the upper annular portion 24 of the inner bag 12 to the outer bag 11, when the inner bag is disposed therein. This means utilizes the rigidity of the outer bag 11 to support the inner bag 12 when the inner bag 12 is disposed therein. In this fashion, the inner bag 12, even with its lack of rigidity, will not collapse. In this respect, it can be seen that forming both the upper annular portions (by which the inner bag 12 is secured to and supported by the outer bag 11) of the inner bag 12 and the outer bag 11 from a substantially rigid material provides additional support and durability. This means further is simple and permits the inner bag 12 to be easily, selectively and alternatively secured to and unsecured from the outer bag 11, so that the inner bag 12 may be alternately removed from the outer bag 11 for use apart therefrom and secured to the outer bag 11 for use therewith, without much difficulty or the necessity of having to remove any of the contents from the inner bag 12.

With reference now to FIGS. 11–15 one means for removably securing the upper annular portion 24 of the inner bag 12 to (preferably, the upper annular portion of) the outer bag 11, when the inner bag 12 is disposed therein is illustrated. In this embodiment, the upper annular portion 24 of the inner bag 12 is formed having at least one, and preferably a plurality of apertures 37 formed therein. It is especially preferred that four of these apertures 37 be provided with two of said apertures 37 being formed on one side of the upper annular portion and with the remaining two apertures 37 formed on the other diametrically opposed side thereof.

Similarly, the (upper annular portion of the) cylindrical side wall 15 of the outer bag 11 is also provided having at least one aperture 38, and preferably, a plurality of apertures 38 formed therein. As with the apertures 37 formed in the inner bag 12 (and described above) it is especially preferred that four of these apertures 38 be provided. Like the inner bag 12, two of these apertures 38 are formed in one side of the cylindrical side wall 15 with the remaining two apertures formed on the other diametrically opposed side thereof.

It is preferred that, in this embodiment and in each of the following embodiments, each of the apertures 37 and 38 be reinforced, so as to prevent their enlargement, distortion and/or obliteration by ripping, pulling etc.

Figure 12:
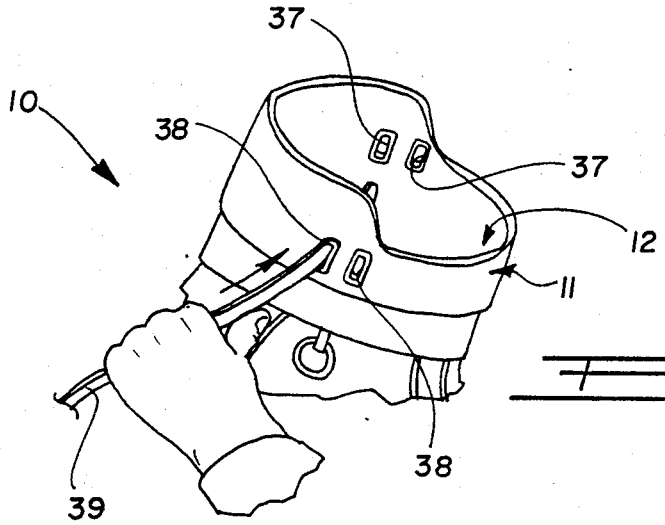
FIG. 12 is a partial perspective view of the upper portions of the outer and inner bags, illustrating alignment of the apertures for securing with a strap.
Figure 13:
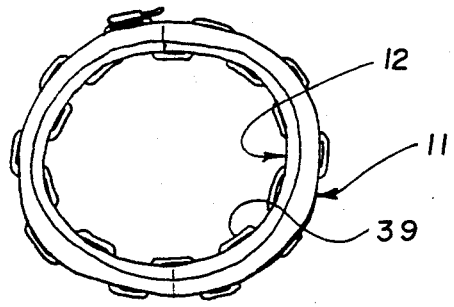
FIGS. 13–15 illustrate three ways in which a strap may be threaded through a plurality of aligned apertures for securing the upper annular portion of the inner bag to the outer bag.

When the inner bag 11 is slidably disposed in the outer bag 12, it is preferred that at least one, and preferably a plurality, of the apertures 38 formed in the side wall 15 of the outer bag 11 are substantially aligned with a respective aperture 37 formed in the upper annular portion 24 of the inner bag 12. In this fashion, at least one and, preferably, a plurality of pairs of aligned apertures is defined. In the preferred embodiment four of such pairs of aligned apertures are defined (FIG. 12).

At least one strap 39 is provided for securing. Each strap 39 has a first end and a second, opposite end. When the inner bag 12 is disposed in the outer bag 11, one of the two ends of the strap 39 may be threadably removably received through, at least, one of the apertures 38 formed in the outer bag 11 and one of the apertures 37 formed in the inner bag 12. In the event that a plurality of pairs of aligned apertures has been defined (as described above), it is preferred that the strap be received through at least one and, most preferably, all of the pairs of aligned apertures. However, it is to be expressly understood that the strap need not be received through each and every aperture (or aligned pair of apertures) provided. Nonetheless, the more apertures through which the strap is received, the more stable will be the securing between the inner and outer bags 11 and 12, respectively.

Figure 15:
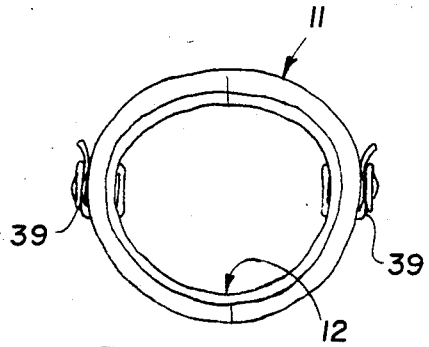
Figure 14:
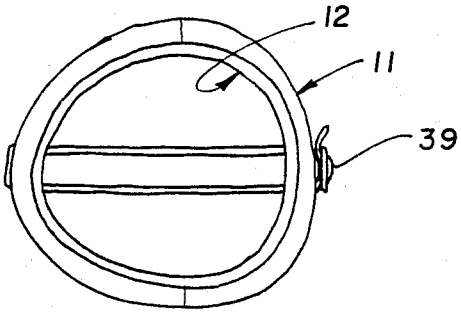

It will also be readily understood that in this embodiment and each of the ones whose descriptions shall follow the strap may be threaded through the apertures in an annular fashion (FIG. 13) or by being extended across the open top (FIG. 14). Also, if desired a plurality of straps 39 may be utilized each of which would be removably threaded through at least one pair of apertures. In this event it is preferred that such straps 39 be equally spaced about the upper annular portion, so as to maintain the inner bag substantially concentrically within the outer bag and to prevent the bag from tipping (FIG. 15).

It is also to be understood that when, as shown in FIG. 14, the strap extends across the open top, it may also serve to support the upper portions of the clubs disposed therein and to aid in separating said clubs from one another.

Once threadably received through the desired apertures 37 and 38 (as described above), the strap 39 is secured, so that the upper annular portion 24 of the inner bag 12 is secured to and supported by the outer bag 11. These straps 39 may be secured in any suitable manner desired and which are readily known to those skilled in the art. For example, if desired, one may simply manually tie and know the first and second ends of the strap together. One may also secure each respective end of the strap 39 to either of the two bags 11 or 12 in any suitable manner. It is, however, preferred that the first end of the strap 39 have a buckle disposed thereon, and that the second opposite end of the strap 39 have at least one aperture formed therein. In this manner, when the second end of the strap is threaded the buckle, the aperture will removably mate therewith, securing the strap 39. As will be readily understood by those skilled in the art, if desired, the second end of the strap 39 may have a plurality of spaced apertures formed therein, so that the strap 39 may be adjustable.

In order to remove the inner bag 12 which is secured as described above, one merely needs to unsecure the strap and threadably remove it from the apertures 37 and 38. Once this is done, the inner bag 12 may be removed from the outer bag 11 for use apart therefrom.

If desired, it is also possible, both in this embodiment once the ones whose descriptions follow, to provide more than one of the straps 39, each of which would be removable threaded through at least one pair of apertures.

As will be readily understood by those skilled in the art, it is preferred that, for the embodiment described above as well as those described below, the portions of the upper annular portion which are secured should be evenly distributed and/or evenly spaced thereabout. For example, if one pair of aligned apertures 37 and 37 is secured on one side of the upper annular portion, a corresponding pair of apertures 37 and 37 should be secured at a diametrically opposed portion (side) thereof. In this manner, more even support is provided to the inner bag 12, so as to prevent its tipping and to maintain it concentrically nested therein.

If desired, the bag 10 described above may also have a cover (which, preferably, is a substantially rigid cover) which is disposed over the open top 22 of the inner bag 12 and secured to the upper annular portion 24 thereof. This cover has at least one aperture formed therein to receive and support golf clubs 1 disposed therethrough. Preferably, a plurality of such apertures are formed in the cover, each being sized to receive and support at least one respective golf club 1 therein. Alternatively, the bag 10 described above may also have a rigid lattice having at least one and, preferably, a plurality of supporting arms. This lattice is disposed over the top 22 of the inner bag 12 and secured thereto. Golf clubs 1 are received through and supported by the lattice.

Figure 16:
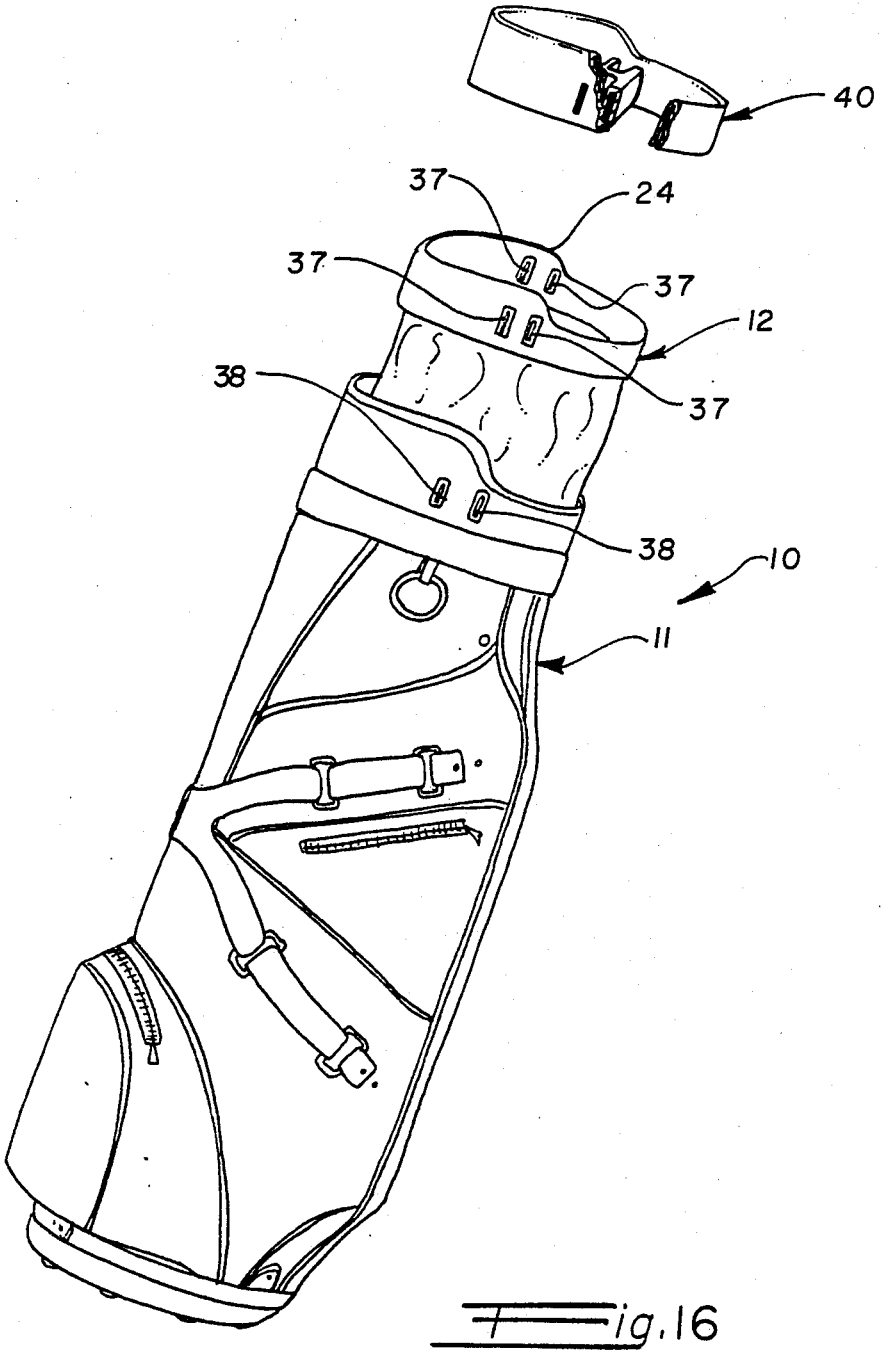
FIG. 16 is an exploded view of one embodiment of the present invention wherein a cover is disposed over the inner bag. Parts of the cover are broken away for the sake of clarity to reveal the interior passageways formed therein.
Figure 17:
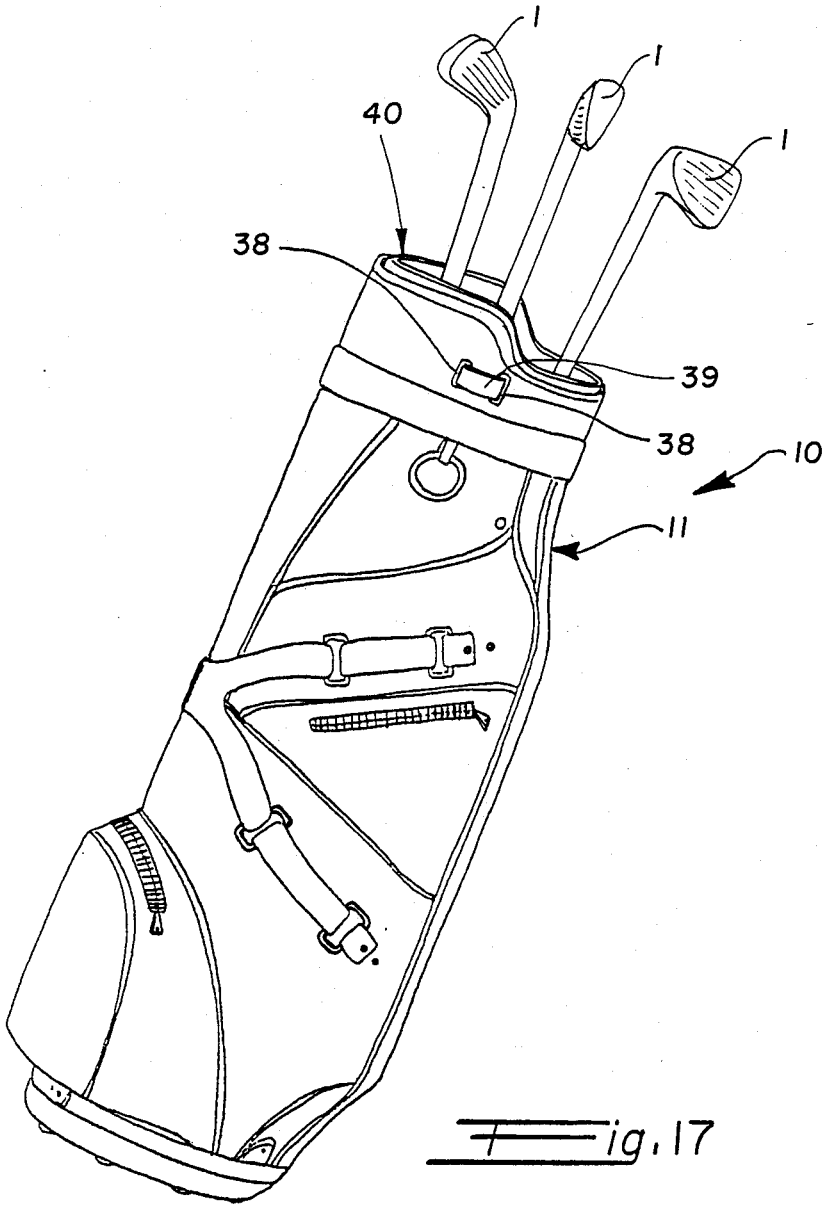
FIG. 17 is a perspective view corresponding substantially to combination bag of FIG. 16 wherein the bag is assembled with the inner bag disposed in the outer bag.

With reference now to FIGS. 16 and 17 another embodiment of the means for removably securing the upper annular portion 24 of the inner bag 12 to the outer bag 11 is illustrated. This embodiment is similar to that which was described above, except that a rigid cover 40 is provided which is disposed over the open top 22. This rigid cover 40 has, at least one and, preferably, a first and a second interior passageway 41 and 42, respectively, formed therein. Each of these passageways 41 and 42 has a pair of open ends. Also, the cylindrical side wall 15 of the outer bag 11, as well as the upper annular portion 24 of the inner bag 12, each have, respectively, at least two apertures 37 and 38 formed therein for each interior passageway 41 and 42 formed therein. Thus in FIGS. 16–17 four apertures 38 are formed in the outer bag 11 and four apertures 37 are formed in the upper annular portion 24 of the inner bag 12. Formed thusly, when the inner bag 12 is disposed in the outer bag 11, each of the apertures 38 formed in the cylindrical side wall 15 of the outer bag 11 is aligned with a respective aperture 37 formed in the upper annular portion 24 of the inner bag 12. In this manner, respective pairs of aligned apertures 37 and 38 are defined. Furthermore, each pair of aligned apertures 37 and 38 is further aligned with a respective open end of a respective interior passageway 41 or 42.

At least one strap 39 having a first end and a second opposite end is provided. When the inner bag 12 is disposed in the outer bag 11, one of the two ends may be threadably, removably received through, at least, one pair of aligned apertures 37 and 38, an open end of an interior passageway 41 aligned therewith, the interior passageway 41, the other aligned open end of the said interior passageway 41 and a pair of aligned apertures 37 and 38 aligned with the said other open end. Preferably, the strap 39 is further threadably received through another pair of aligned apertures 37 and 38, the open end of the second interior passageway 42 aligned with said another pair of aligned apertures, 37 and 38, the second interior passageway 42, the other open end of the second interior passageway 42 and a pair of aligned apertures 37 and 38 aligned with the said other open end of the second interior passageway 42 (FIG. 17).

Once threadably received as described above, the strap 39 is secured, so that the upper annular portion 24 of the inner bag 12 is secured to and supported by the outer bag 11. Once again, these straps 39 may be secured in any suitable manner as was described in detail above. Once again, it is preferred that a buckle be provided for adjustable securing of the strap 39.

In order to remove the inner bag 12, which is secured as described above, one needs merely to unsecure the strap 39 and threadably remove it from the pairs of aligned apertures 37 and 38, the interior passageways 41 and 42 and the open ends thereof. Once this is done, the inner bag 12 may be removed from the outer bag 11 for use apart therefrom.

In addition to being secured to the upper annular portion, as described above, the cover 40 may further be secured to the upper annular portion 24 of the inner bag 12 by any suitable means, such as sewing, heat process etc.

Figure 18:
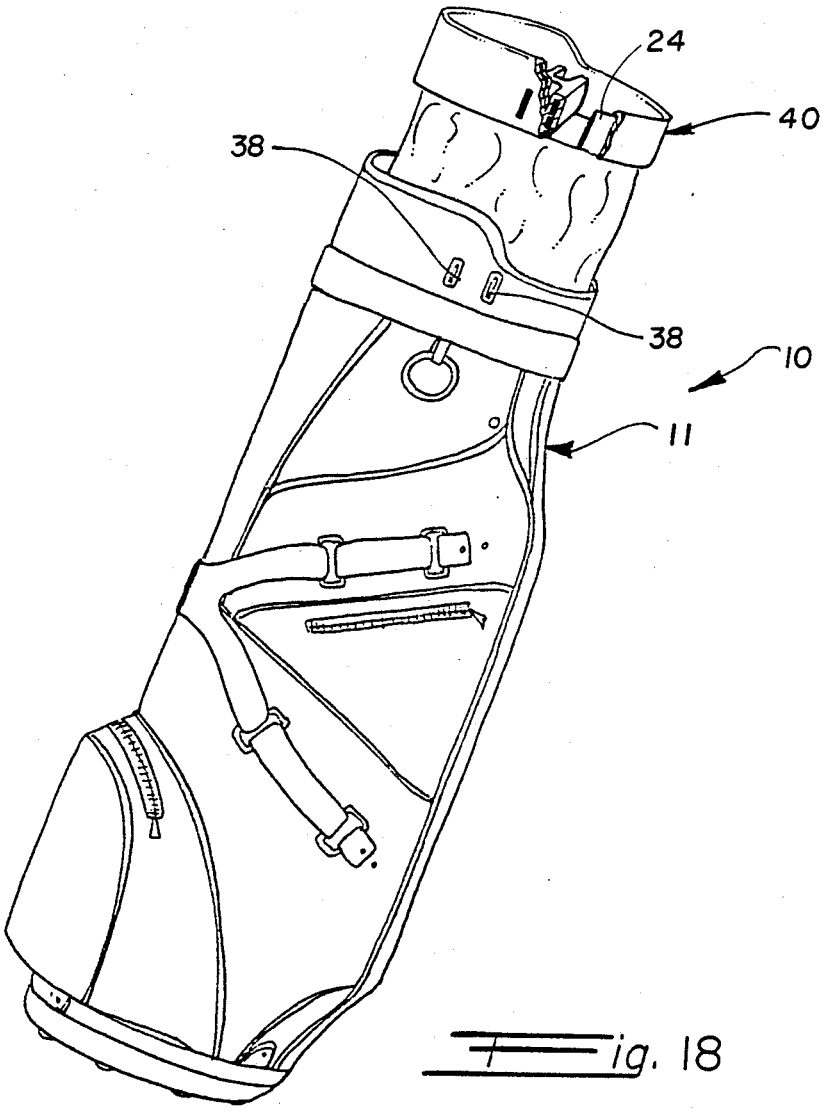
FIG. 18 is a perspective view of another embodiment of the present invention wherein the cover is directly secured to the inner bag at all times.
Figure 19:
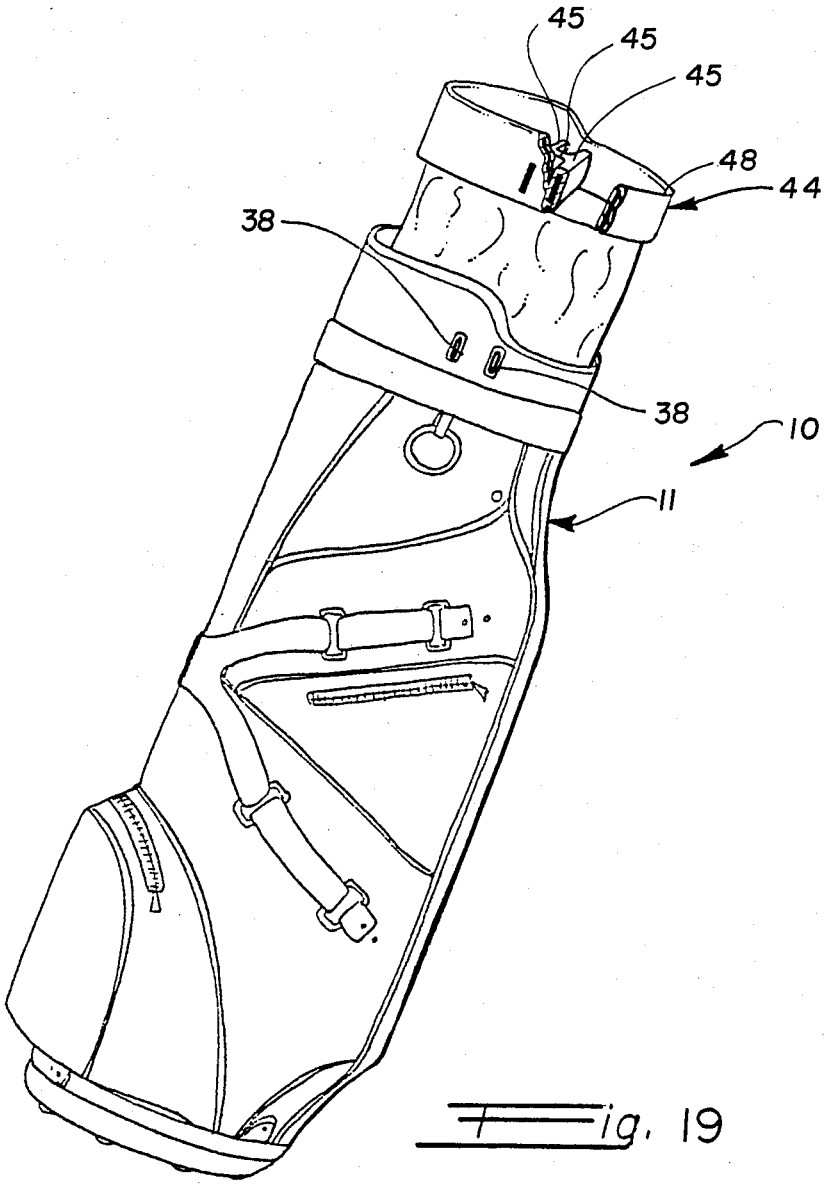
FIG. 19 is an exploded view of another embodiment of the present invention wherein a lattice is disposed over the inner bag. For the sake of clarity parts of the lattice are broken away to reveal the interior passageways formed therein.

Alternatively, as can be seen by reference to FIG. 18, the cover 40 may be directly secured to the upper annular portion 24 of the inner bag 12 by any suitable means, such as sewing, heat processing, etc. Also, the apertures 37 formed in the upper annular portion 24 of the inner bag 12 are omitted. In this embodiment, the cover 40 has at least one, and preferably two (a first and a second) interior passageways 41 and 42 formed therein. Each of said passageways 41 and 42 has a pair of opposite open ends. In such a case, the cylindrical side wall 15 of the outer bag 11 would have at least one aperture 38, and preferably, at least a pair of apertures 38 formed therein for each interior passageway formed in the cover 40. Thus, in FIG. 18, four apertures 38 are formed in the upper annular portion of the outer bag 11. Formed thusly, when the inner bag 12 is disposed in the outer bag 11, at least one and, preferably, each of the apertures 38 formed in the cylindrical side wall 15 is aligned with an open end of a respective interior passageway.

Positioned as described above, the strap 39 is then threadably, removably received through, at least, the interior passageways, the open ends thereof and the apertures 38 aligned therewith. Once threadably received as described above, the strap 39 is secured so that the upper annular portion 24 of the inner bag 12 is secured to and supported by the outer bag 11. Once again, these straps 39 may be secured in any suitable manner by the means therefor, such as an adjustable buckle, as was described above.

With reference now to FIGS. 19–22, still another embodiment of the means for removably securing the upper annular portion of the inner bag to the outer bag is illustrated. This embodiment is similar to the bag described above except that a rigid lattice 44 is disposed over the bag 12 in place of the cover 40. This rigid lattice 44 may be formed having any suitable shape. However it is preferred that this lattice 44 have a annular portion 48. This rigid lattice 44 also has at least one and, preferably, a plurality of supporting arms 45. At least one and, preferably, two of these supporting arms 45 has a respective interior passageway 46 formed therein (a first and a second interior passageway). Each of said passageways 46 has a pair of open ends. Also, the cylindrical side wall 15 of the outer bag 11, as well as the upper annular portion 24 of the inner bag 12 each have, respectively, at least two apertures 37 and 38 formed therein for each interior passageway 46 formed in the lattice 44. Thus, in FIGS. 19 and 20, four apertures 37 and 38 are formed in both the upper annular portion 24 of the inner bag 12 as well as in the (upper annular portion of) the outer bag 11. Formed thusly, when the inner bag 12 is disposed in the outer bag 11, each of the apertures 38 formed in the cylindrical side wall 15 of the outer bag 11 is aligned with a respective aperture 37 formed in the upper annular portion 24 of the inner bag 12. In this manner, respective pairs of aligned apertures 37 and 38 are defined. Furthermore, each pair of aligned apertures 37 and 38 is further aligned with a respective open end of a respective open end of an interior passageway 46.

Figure 20:
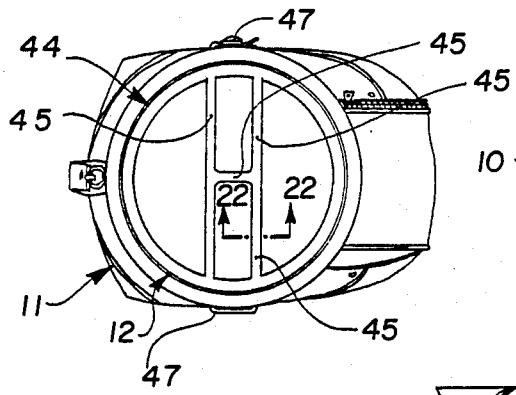
FIG. 20 is an overhead view of the assembled bag of FIG. 19.
Figure 21:
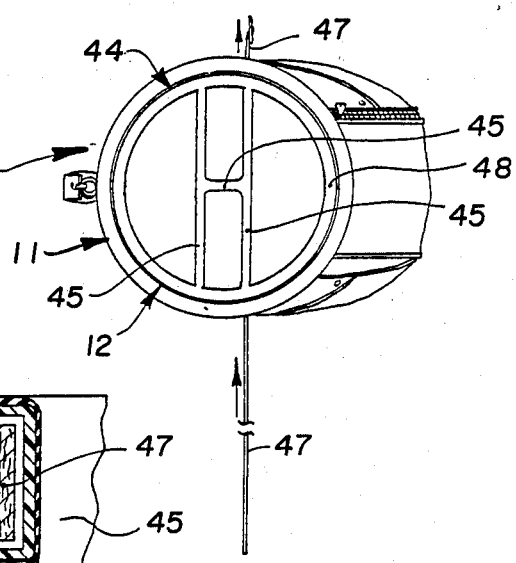
FIG. 21 is another overhead view relating substantially to FIG. 20, wherein the strap is threaded through the interior passageways of the lattice.
Figure 22:
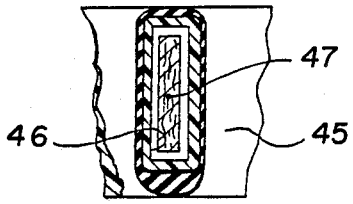
FIG. 22 is a partial cross-section view taken along lines 22—22 of FIG. 20, showing the positioning of the strap as it is threaded through an interior passageway in the lattice.

At least one strap 47 having a first end and a second opposite end is provided. When the inner bag 12 is disposed in the outer bag 11, one of the two ends may be threadably, removably received through, at least, one pair of aligned apertures 37 and 38, an open end of an interior passageway 46 aligned therewith, the interior passageway 46, the other aligned open end of the said interior passageway 46 and a pair of aligned apertures 37 and 38, aligned with the said other open end. Preferably, the strap 47 is further threadably received through another pair of aligned apertures 37 and 38, the open end of the second interior passageway 46 aligned with said another pair of aligned apertures 37 and 38, the second interior passageway 46, the other open end of the second interior passageway 46 and a pair of aligned apertures 37 and 38 aligned with the said other open end of the second interior passageway 46 (FIG. 20).

Once threadably received as described above, the strap 47 is secured, so that the upper annular portion 24 of the inner bag 12 is secured to and supported by the outer bag 11. Once again these straps 47 may be secured in any suitable manner, as was described in detail above. Once again it is preferred that a buckle be provided for adjustably securing the strap 47.

In order to remove the inner bag 12, which is secured as described above, one needs merely to unsecure the strap 47 and threadably remove it from the pairs of aligned apertures 37 and 38, the interior passageways 46 and the open ends thereof. Once this is done, the inner bag 12 may be removed from the outer bag 11 for use apart therefrom.

In addition to being secured to the upper annular portion, as described above, the lattice 44 may further be secured to the upper annular portion 24 of the inner bag 12 by any suitable means, such as sewing, heat processing, etc.

Alternatively, the lattice 44 may be directly secured to the upper annular portion 24 of the inner bag 12 by any suitable means, such as sewing, heat processing, etc. Also, the apertures 37 formed in the upper annular portion 2, of the inner bag 12 are omitted. In this embodiment, the lattice 44 has at least one, and preferably two (a first and a second) interior passageways 46 formed therein. Each of said passageways 46 has a pair of opposite open ends. In such a case, the cylindrical side wall 15 of the outer bag 11 would have at least one aperture 38, and preferably, at least a pair of apertures 38 formed therein for each interior passageway formed in the lattice 44. Thus, four apertures 38 are formed in the upper annular portion of the outer bag 11. Formed thusly, when the inner bag 12 is disposed in the outer bag 11, at least one and, preferably, each of the apertures 38 formed in the cylindrical side wall 15 is aligned with an open end of a respective interior passageway.

Positioned as described above, the strap 47 is then threadably, removably received through, at least, the interior passageways, the open ends thereof and the apertures 38 aligned therewith. Once threadably received as described above, the strap 47 is secured so that the upper annular portion 24 of the inner bag 12 is secured to and supported by the outer bag 11. Once again, these straps 47 may be secured in any suitable manner by the means therefor, such as an adjustable buckle, as was described above.

Figure 23:
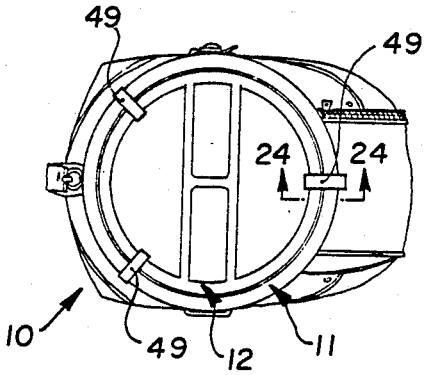
FIG. 23 is an overhead view of another embodiment of the combination bag wherein hook and loop fasteners secure the inner bag.
Figure 24:
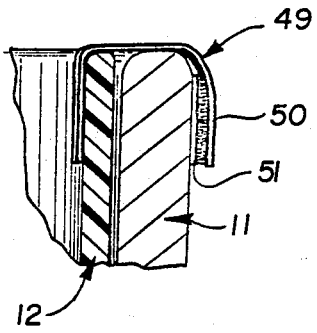
FIG. 24 is a partial cross-section view taken along lines 24—24 of FIG. 23.

With reference now to FIGS. 23 and 24, still another embodiment of the means for removably securing the upper annular portion 24 of the inner bag 12 to the outer bag 11 is illustrated. In this embodiment, at least one and, preferably, a plurality of hook and loop fasteners 49 is provided. Each of these fasteners 49 has a respective hook portion 50 and a respective loop portion 51. These portions 50 and 51 removably mate with one another providing for selective, easy and expeditious securing and unsecuring therebetween. An example of such a fastener 49 are those nylon tape fasteners commonly referred to as "velcro" manufactured by the Velcro Corp. of New York.

At least one of the hook and loop portions 50 or 51, respectively, is disposed on the upper annular portion 24 of the inner bag 12. Preferably as illustrated perhaps most clearly in FIG. 24, said portions are located on the first end of a flap. The second end of this flap is attached by sewing etc. to the inwardly facing surface of the inner bag. Also, at least one of the other hook or loop portions 50 and 51 is disposed on the (upper annular portion of) the outer bag 11 preferably facing outwardly. Preferably, a plurality of said portions 50 and 51 are disposed as described above, being evenly spaced apart from one another, so as to substantially concentrically support the inner bag 12 in the outer bag 11. It is most preferred to provide three such fasteners 49, with the respective portions thereof being spaced substantially 120° from one another.

Figure 25:
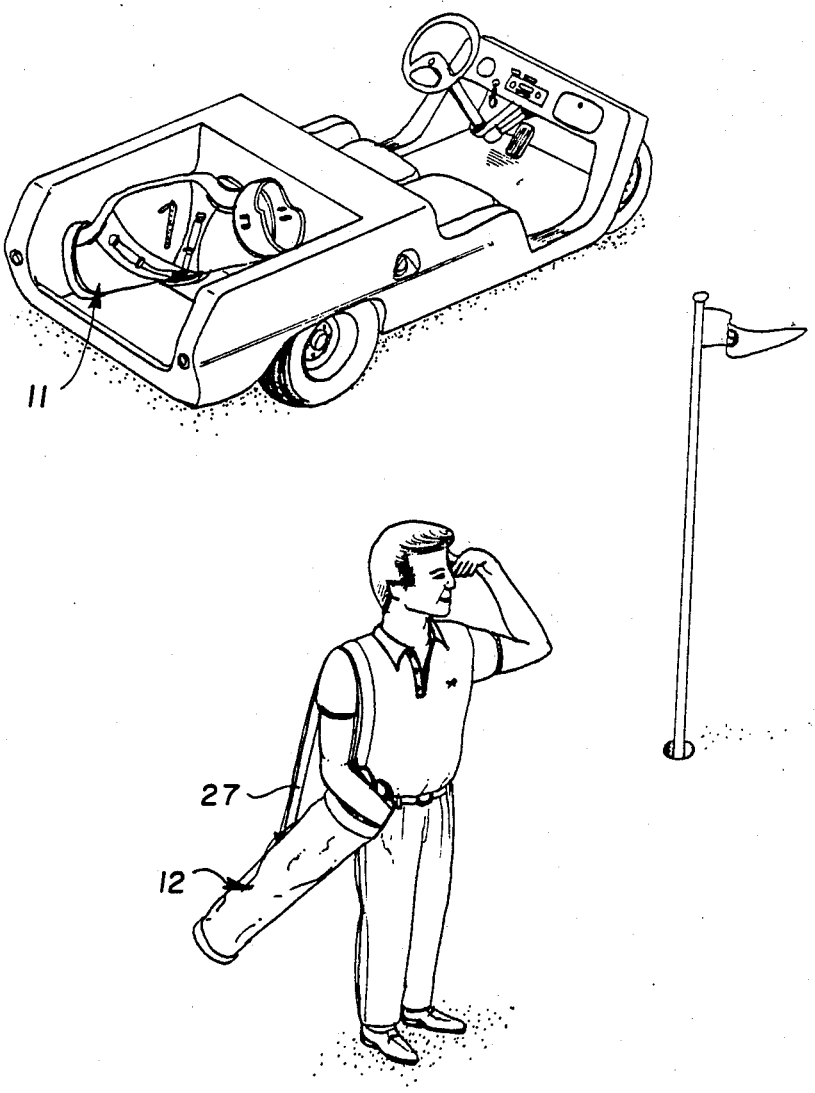
FIG. 25 illustrates the inner bag being utilized apart from the outer bag after it has been unsecured therefrom.

Disposed thusly, when the inner bag 12 is slidably disposed in the outer bag, the flap may be wrapped around the upper periphery of both the inner and outer bags 12 and 11 respectively, so that at least one and preferably each of the hook portions 50 mates with its respective loop portion 51, fastening the upper annular portion 24 of the inner bag 12 to the outer bag 11. In this fashion, the upper annular portion 24 of the inner bag 12 is secured to and supported by the outer bag 11. When desired, the respective portions 50 and 51 of each of the fasteners 49 may be unsecured from one another and the inner bag 12 may be removed from the outer bag 11 for use apart therefrom (FIG. 25).

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A golf bag for carrying golf clubs comprised of:

an outer bag having a substantially rigid cylindrical side wall, a bottom and an open top, the cylindrical side wall of the outer bag having a first aperture and at least two additional apertures formed therein;

an inner bag, slidably removably disposed in the outer bag, the inner bag having a bottom, an open top for removably receiving golf clubs therein and a substantially cylindrical, non-rigid side wall extending between the bottom and the top whereby when slidably disposed in the outer bag, the inner bag is nested substantially concentrically therein;

an inner bag having an upper annular portion formed on the wall thereof, an element carried by the upper annular portion of the inner bag and projecting radially thereof, the element being received in the first aperture in the outer bag such that when the inner bag is nested within the outer bag, substantial rotational movement of the inner bag relative to the outer bag is prevented and wherein the element may be withdrawn from within the first aperture so as to clear the outer bag as the inner bag is pulled out of the outer bag;

the upper annular portion of the inner bag having at least two apertures formed therein; and a strap having means for removably securing and supporting the upper annular portion of the inner bag to the outer bag, wherein when the inner bag is disposed in the outer bag, the strap may be threadably, removably received through the at least two additional apertures formed in the outer bag and the at least two apertures formed in the inner bag and secured, so that the upper annular portion of the inner bag is secured to and supported by the outer bag, and further wherein the strap may be unsecured and threadably removed from the apertures, so that when the strap is removed and the element carried by the upper annular portion of the inner bag is withdrawn from the first aperture in the outer bag, the inner bag may be removed from the outer bag for use to house golf clubs apart from the outer bag.

2. A golf bag for carrying golf clubs comprised of:

an outer bag having a substantially rigid cylindrical side wall, a bottom and an open top, the cylindrical side wall of the outer bag having a first aperture and at least two additional apertures formed therein;

an inner bag, slidably removably disposed in the outer bag, the inner bag having a bottom, an open top for removably receiving golf clubs therein and a substantially cylindrical, non-rigid side wall extending between the bottom and the top whereby when slidably disposed in the outer bag, the inner bag is nested substantially concentrically therein;

the inner bag having an upper annular portion formed on the wall thereof, an element carried by the upper annular portion of the inner bag and projecting radially thereof, the element being received in the first aperture in the outer bag such that when the inner bag is nested within the outer bag, substantial rotational movement of the inner bag relative to the outer bag is prevented and wherein the element may be withdrawn from within the first aperture so as to clear the outer bag as the inner bag is pulled out of the outer bag;

the upper annular portion of the inner bag having at least two apertures formed therein, so that when the inner bag is disposed within the outer bag the at least two additional apertures formed in the side wall of the outer bag are substantially aligned with the at least two respective apertures formed in the upper annular portion of the inner bag, thereby defining at least two pairs of aligned apertures; and a strap having means for removably securing and supporting the upper annular portion of the inner bag to the outer bag, wherein when the inner bag is disposed in the outer bag, the strap may be threadably, removably received through at least two pairs of aligned apertures and secured, so that the upper annular portion of the inner bag is secured to and supported by the outer bag, and further wherein the strap may be unsecured and threadably removed from at least two pairs of aligned apertures, so that when the strap is removed and the element carried by the upper annular portion of the inner bag is withdrawn from the first aperture in the outer body, the inner bag may be removed from the outer bag for use to house golf clubs apart from the outer bag.

3. The golf bag of claim 2, wherein the means for removably securing the upper annular portion of the inner bag to the outer bag when the inner bag is disposed therein is further comprised of:

the upper annular portion of the inner bag having a plurality of apertures formed therein;

the cylindrical side wall of the outer bag having a plurality of apertures formed therein, so that when the inner bag is disposed within the outer bag, a plurality of said apertures formed in the side wall of the outer bag are substantially aligned with a respective aperture formed in the inner bag, thereby defining a plurality of pairs of aligned apertures; and wherein the strap may be threadably, removably received through at least a plurality of the said pairs of aligned apertures and secured, so that the upper annular portion of the inner bag is secured to and supported by the outer bag, and further wherein the strap may be unsecured and threadably removed from the apertures, so that the inner bag may be removed from the outer bag for use apart therefrom.

4. The golf bag of claim 2, wherein the strap has a first end and a second opposite end; and wherein the means for removably securing and supporting the upper annular portion of the inner bag to the outer bag is comprised of:

a buckle secured to the first end of the strap; and the second opposite end of the strap having at least one aperture formed therein for removably mating with the buckle.

5. A golf bag for carrying golf clubs, comprised of:

an outer bag having a substantially rigid cylindrical side wall, a bottom and an open top;

An inner bag, slidably removably disposed in the outer bag, the inner bag having a substantially non-rigid side wall, a bottom and an open top for removably receiving golf clubs therein, whereby when slidably disposed in the outer bag, the inner bag is nested substantially concentrically therein;

the inner bag having an upper annular portion formed on the side wall thereof;

means for removably securing the upper annular portion of the inner bag to the outer bag when the inner bag is disposed therein, such that the inner bag may be selectively and alternatively removed from the outer bag for use apart therefrom, or disposed and supported within the outer bag during use thereof;

a first ring disposed on the side wall of the inner bag and a second ring disposed on the side wall of the inner bag between the first ring and the bottom of the inner bag;

a pair of ring apertures formed in the side wall of the outer bag, wherein when the inner bag is disposed in the outer bag, each ring is received through a respective ring aperture, and further wherein when the inner bag is removed from the outer bag, the rings are removed from the respective aperture;

a strap having a first end and a second opposite ends;

a first latch disposed on the first end of the strap and a second latch disposed on the second end of the strap;

when the inner bag is disposed in the outer bag with the rings received through a respective ring aperture, the first latch may be removably secured to the first ring and the second latch may be removably secured to the second ring, thereby securing the rings in place and providing a strap for carrying the outer bag having the inner bag disposed therein; and when the inner bag is removed from the outer bag for use apart therefrom, the first latch may be removably secured to the first ring and the second latch may be removably secured to the second ring, providing a strap for carrying the inner bag when used apart from the outer bag.

6. A golf bag for carrying golf clubs, comprised of:

an outer bag having a substantially rigid cylindrical side wall, a bottom and an open top;

an inner bag, slidably removably disposed in the outer bag, the inner bag having a bottom, an open top removably receiving golf clubs therein and a side wall extending between the bottom and the top, whereby when slidably disposed in the outer bag, the inner bag is nested substantially concentrically therein;

the inner bag having an upper annular portion formed on the side wall thereof;

means for removably securing the upper annular portion of the inner bag to the outer bag when the inner bag is disposed therein, such that the inner bag may be selectively and alternatively removed from the outer bag for use apart therefrom, or disposed and supported within the outer bag during use thereof;

the last named means including an element carried by the upper annular portion of the inner bag and projecting radially thereof, and the outer bag having an aperture formed therein through which the element is received when the inner bag is nested within the outer bag, thereby preventing substantial rotational movement of the inner bag relative to the outer bag and wherein the element may be withdrawn from within the aperture so as to clear the outer bag as the inner bag is pulled out of the outer bag and such that the inner bag may thereafter be used to house golf clubs apart from the outer bag; and wherein the element extending from the inner bag is a ring secured to the inner bag so that when the inner bag is disposed in the outer bag, the aperture in the outer bag is substantially aligned with the ring on the inner bag and the ring may extend therethrough.

7. A golf bag for carrying golf clubs, comprised of:

an outer bag having a substantially rigid cylindrical side wall, a bottom and an open top;

an inner bag, slidably removably disposed in the outer bag, the inner bag having a bottom, an open top for removably receiving golf clubs therein and a side wall extending between the bottom and the top, whereby when slidably disposed in the outer bag, the inner bag is nested substantially concentrically therein;

the inner bag having an upper annular portion formed on the side wall thereof;

means for removably securing the upper annular portion of the inner bag to the outer bag when the inner bag is disposed therein, such that the inner bag may be selectively and alternatively removed from the outer bag for use apart therefrom, or disposed and supported within the outer bag during use thereof;

the last named means including an element carried by the upper annular portion of the inner bag and projecting radially thereof, and the outer bag having an aperture formed therein through which the element is received when the inner bag is nested within the outer bag, thereby preventing substantial rotational movement of the inner bag relative to the outer bag and wherein the element may be withdrawn from within the aperture so as to clear the outer bag as the inner bag is pulled out of the outer bag and such that the inner bag may thereafter be used to house golf clubs apart from the outer bag; and wherein the element extending from the inner bag is a pair of spaced apart rings secured to the side wall of the inner bag and a pair of corresponding spaced apart ring apertures formed in the wall of the outer bag wherein when the inner bag is disposed in the outer bag, the apertures in the outer bag are substantially aligned with the rings on the inner bag such that the rings may extend therethrough and when the inner bag is removed from the outer bag, the rings are removed from the respective apertures.

* * * * *